US006698139B1

(12) United States Patent
Scholes

(10) Patent No.: US 6,698,139 B1
(45) Date of Patent: Mar. 2, 2004

(54) SLIDING SASH WINDOW ASSEMBLY

(76) Inventor: Duncan Scholes, St. Thomas Road, Longroyd Bridge, Haddersfield (GB), HD1 3LF ( * ) Notice: Subject to any disclaimer, the term of this patent is extended or adjusted under 35 U.S.C. 154(b) by 0 days.

(21) Appl. No.: 09/980,181

(22) PCT Filed: May 26, 2000

(86) PCT No.: PCT/GB00/01951

§ 371 (c)(1),
(2), (4) Date: Feb. 22, 2002

(87) PCT Pub. No.: WO00/73612

PCT Pub. Date: Dec. 7, 2000

(30) Foreign Application Priority Data

May 28, 1999 (GB) ..... 9912556
Nov. 26, 1999 (GB) ..... 9927862

(51) Int. Cl.[7] ..... E05F 1/00
(52) U.S. Cl. ..... 49/447
(58) Field of Search ..... 49/163, 176, 445, 49/447, 449; 16/193, 194, 218, DIG. 8

(56) References Cited

U.S. PATENT DOCUMENTS

| | | | | | |
|---|---|---|---|---|---|
| 151,629 | A | * | 6/1874 | Sprague | 16/218 |
| 879,906 | A | * | 2/1908 | Rhorer | 16/218 |
| 1,384,074 | A | | 7/1921 | Leonard | |
| 1,480,099 | A | * | 1/1924 | Murphy | 16/218 |
| 2,865,061 | A | | 12/1958 | Kunkel | |
| 5,558,147 | A | | 9/1996 | Nofziger | |
| 5,566,511 | A | | 10/1996 | Van Drimmelen | |
| 5,661,927 | A | * | 9/1997 | Polowinczak et al. | 49/449 |
| 6,230,443 | B1 | * | 5/2001 | Schultz | 49/183 |
| 6,393,661 | B1 | * | 5/2002 | Braid et al. | 16/197 |

FOREIGN PATENT DOCUMENTS

| | | |
|---|---|---|
| DE | 37 19533 | 12/1988 |
| GB | 15078 | 6/1913 |
| GB | 217759 | 7/1924 |
| GB | 2 295 634 | 6/1996 |

* cited by examiner

*Primary Examiner*—Jerry Redman
(74) *Attorney, Agent, or Firm*—Leydig, Voit & Mayer Ltd.

(57) ABSTRACT

A sliding sash window assembly which comprises a fixed rectangular outer frame securable in a window aperture and having upper and lower window units (13, 14) mounted in the fixed outer frame and at least one of which is relatively movable between an open position and a closed position of the window assembly, and respective rectangular frames for the units arranged to permit lower horizontal frame member of the upper unit (13) to be located alongside an upper horizontal frame member of the lower unit (14) when the window assembly is closed, so that a locking element can lock the frame members to each other. The rectangular outer frame has side frames in which counterweight arrangements are housed, and forming a stack of weights which can be pulled upwardly within the housing by an elongate tensile element (20) which is secured at one end at or near the lower end of the stack, and at its other end is engageable with a lower end region of the movable window unit. Each elongate tensile element (20) is routed through an aperture in one of the facings which is located generally at the level of the lower frame member of the upper unit and the upper frame member of the lower unit is the closed position of the window assembly, so that the aperture is concealed from view, and also the tensile element also is not visible.

17 Claims, 13 Drawing Sheets

WORKING MOTION:-

Internal lining is pulled off the outer frame

Lower sash is dropped inward from its base to a maximum working level

Parting bead section is pulled off the outer frame

Upper sash is lowered inward from its base untill it rests on the other sash

ILLUSTRATES THE PRINCIPAL FOR CLEANING BOTH LOWER, (INNER), AND UPPER, (OUTER), SASH:-

The inner sash must rest on a stay for its maximum reach

The outer sash will rest on the inner

Lower sash opened, push to release shank activated, sash lowered onto service shank Internal linings flicked open Lower sash lowered. Arm is fastened to service groove therby securing sash Upper sash lowered onto service axle, activated as before Parting bead section removed Upper sash lowered onto restricted lower sash FIG. 9
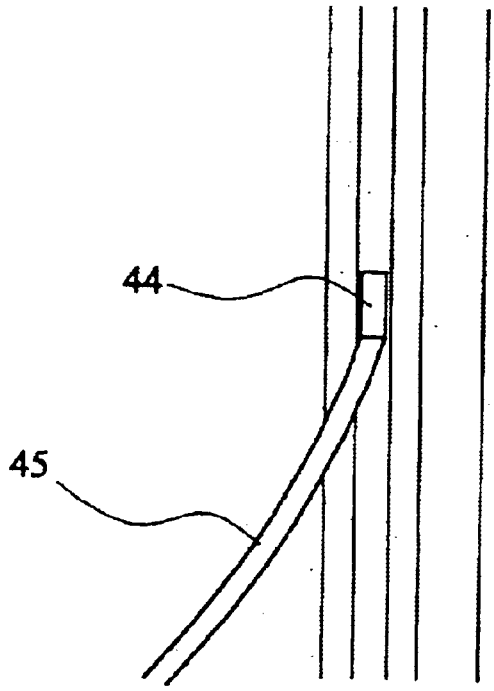
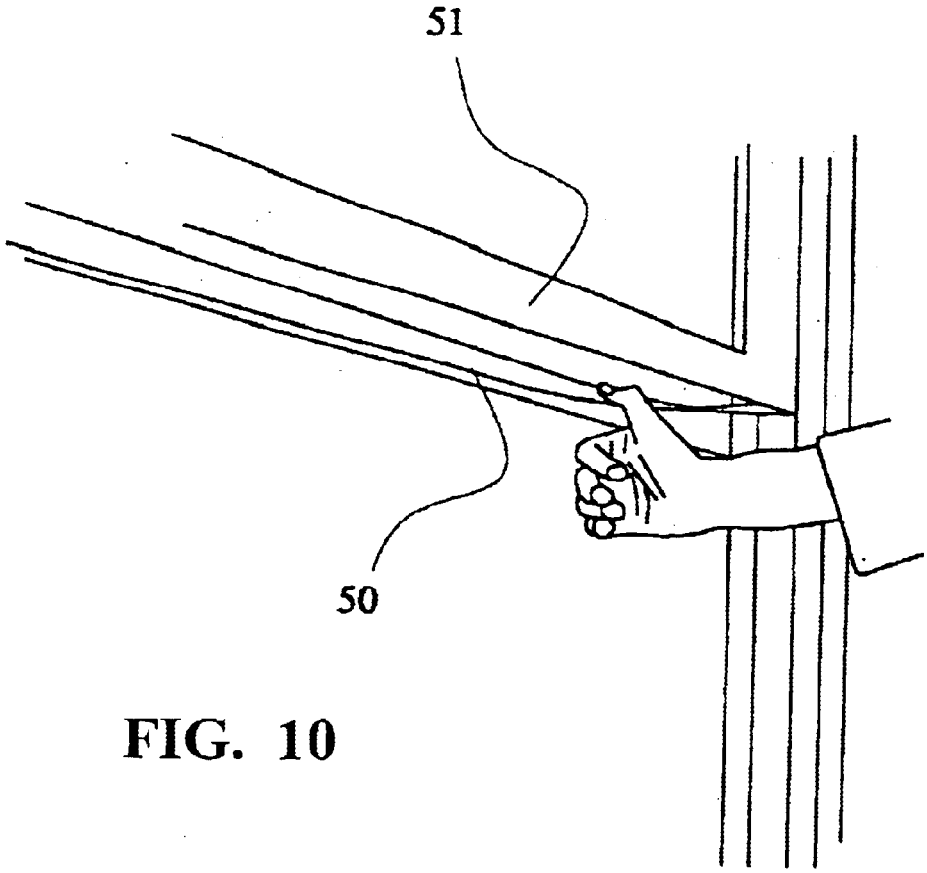
FIG. 10

SLIDING SASH WINDOW ASSEMBLY

This invention relates to a sliding sash type window assembly which comprises a fixed rectangular outer frame securable in a window aperture in a building, upper and lower window units mounted in the fixed outer frame with at least one of said units being movable between an open position and a closed position of the window assembly, and respective rectangular frames for said units arranged to permit a lower horizontal frame member of the upper unit to be located alongside an upper horizontal frame member of the lower unit when the window assembly is closed so that a locking element can lock the frame members to each other and thereby prevent unauthorised attempt at forced opening of the window assembly.

Sliding sash type windows have been supplied with timber frames for many years, in which both the upper and the lower window units are capable of vertical sliding movement (one in front of the other) within guide tracks provided in the outer frame, and usually the upper unit is stepped outwardly of the lower unit i.e. it moves in an outer vertical plane which is spaced from an inner plane in which the lower unit is movable. The lower horizontal frame member of the upper unit is located alongside the upper horizontal frame member of the lower unit when both units are in their closed positions, and a suitable lock e.g. a Fitch lock secures the frame members together to prevent forced opening of the window assembly.

Timber frame window units, and the glazing of the units, are heavy, and therefore to facilitate opening and closing movement of the units, it has been traditional to provide counterweight arrangements comprising lead weights, cords and pulleys. The lead weights move up and down within concealed vertical passages defined behind front facings of the vertical side frame members of the fixed frame, but the cords which transmit tensile loads between the lead weights and the window units necessarily are exposed to view, since they must run down the exposed facings to make connections with anchor points on the side frames of the window units.

It is also known to provide adjustable spring assemblies, to provide counterbalance forces to the weights of the sliding sash window units. However, these are quite complicated, expensive, and can require maintenance over a period of time, which is a serious drawback to potential users.

In order to provide for ease of upward and downward movement of sash window units (bearing in mind that the timber components may change in size with temperature changes, or swelling with moisture ingress), it is usual to provide substantial clearances to the movement of the units within the guide provided in the vertical frame members of the fixed frame. This means that in practice when the units are closed, there are often substantial air gaps between the sash window units and the fixed outer frame, which allow drafts of external air to pass through the gaps and into a room. Also, in windy conditions, the sash units can clatter against each other.

Both of these factors are an inevitable feature of traditional timber designs of sash windows, whether genuinely old installations e.g. for Victorian or earlier eras, or from more modern installations in timber.

However, despite these drawbacks, there is substantial design appeal to customers of traditional designs of timber sliding sash windows, and there is a clear commercial demand for the design appeal of these traditional designs to be made available, but preferably utilising more modern materials and sealing techniques, and particularly extruded PVCU sections fibreglass mouldings or aluminium. However, for some users, the invention may be applied to timber framed windows.

To satisfy this need, initial attempts have concentrated on providing a visual illusion i.e. a simulation of vertically sliding sash window units, and using PVCU material to form the fixed outer frame and also the frames of the sash units mounted therein. To form the illusion, it is necessary to mount the sash units in respective off-set vertical planes, so as to make it appear as if the units could be slid vertically one in front of the other.

However, in practice, the lower unit is usually fixedly mounted in the outer frame, and the upper unit is a "top open" window which can move hingedly outwardly about an upper horizontal hinge axis.

By this illusion, while using modern materials, the appearance of sliding sash window units can be obtained, but without need to provide (a) counterweight arrangements and (b) vertical guide tracks in the side frame members of the fixed frame.

SUMMARY OF THE INVENTION

The present invention approaches the task of simulating traditional timber frame sliding sash designs, using modern materials, and in a way which actually replicates the vertical sliding movement of traditional timber designs, but also utilising counterweight arrangements which are technically and/or visually improved over existing arrangements.

According to one aspect of the invention there is provided a sliding sash window assembly which comprises a fixed rectangular outer frame securable in a window aperture in a building, upper and lower window units mounted in the fixed outer frame and at of said units being relatively movable between an open position and a closed position of the window assembly, respective rectangular frames for said units arranged to permit a lower horizontal frame member of the upper unit to be located alongside an upper horizontal frame member of the lower unit when the window assembly is closed and a locking element for locking the frame members to each other in a closed position and thereby preventing unauthorized attempts at forced opening of the window assembly, in which:

(a) the rectangular outer frame has side frame members in which counterweight arrangements are housed and which are operable to control the upward and downward sliding movement of said one movable window unit in said outer frame, the side frame members having facing to conceal the counterweight arrangements from view;

(b) each counterweight arrangement includes an elongate tensile element which is connected at one end to a lower end region of said one movable window unit and which is connected at its opposite end to a load which is housed behind the respective facing whereby one portion of the elongate tensile element is also located behind the facing, and another portion of the elongate tensile element extends upwardly of said lower end region of said one movable window unit and alongside a side frame thereof during raising and lowering movement of said one movable window unit; and, (c) each elongate tensile element is routed through an aperture in a respective one of the facings which is located generally at the level of the lower horizontal frame member of the upper unit and the upper horizontal frame member of the lower unit in the closed position of the window assembly so that, when in this position, the aperture is concealed from view and the tensile element also is not visible.

According to a second aspect of the invention there is provided a sliding sash window assembly which comprises a fixed rectangular outer frame securable in a window aperture in a building, upper and lower window units mounted in the fixed outer frame and one of said units being relatively movable between an open position and a closed position of the window assembly, and respective rectangular frames for said units arranged to permit a lower horizontal frame member of the upper unit to be located alongside an upper horizontal frame member of the lower unit when the window assembly is closed so that a locking element can lock the frame members to each other and thereby prevent unauthorized attempts at forced opening of the window assembly, in which:

(a) the rectangular outer frame has side frames in which counterweight arrangements are housed and which are operable to control the upward and downward sliding movement of said one movable window unit in said outer frame, the side frames having facings to conceal the counterweight arrangements from view;

(b) each counterweight arrangement includes a load connected to an elongate tensile element and which is engageable with a lower end region of said one movable window unit, wherein the elongated tensile element is made of at least one of a belt and a web which is formed from at least one of a plastics material and a reinforced plastics material; and, (c) each elongate tensile element is routed through an aperture in a respective one of the facings which is located generally at the level of the lower frame member of the upper unit and the upper frame member of the lower unit in the closed position of the window assembly so that, when in this position, the aperture is concealed from view and the tensile element also is not visible, and the elongate tensile element is taken below the lower frame member of said one movable window unit, and each end of the elongate tensile element is connected to a respective counter weight whereby the two counterweights apply an upward force to said movable window unit via the engagement of the elongate tensile element with the lower frame member.

Therefore, a window assembly according to this one aspect of the invention has the advantage of being able to simulate traditional timber designs of sash windows if required, but usually without the unsightly aspect of having the elongate tensile element exposed to view when the assembly is in the closed position. The rectangular outer frame, and the frames of the upper and lower units may be of plastics material, e.g. PVCU, aluminium or timber.

For some embodiments of the invention the load of each counterweight arrangement comprises a stack of at least two weights which are capable of being fed through an entrance aperture into the respective housing in order to be mounted therein for vertical sliding movement.

Therefore, a window assembly according to the second aspect of the invention has an easily installed counterweight arrangement, in that each counterweight arrangement of at least two weights allows easy installation of the counterweight via the aperture.

The frames of the window assembly may be made of plastics e.g. PVCU, fibreglass, aluminium or timber.

Preferably, the aperture is located at the level of the lower frame member of the upper unit and the upper frame member of the lower unit in the closed position of the window assembly so that, when in this position, the aperture is concealed from view and the tensile element also is not visible. However, entrance apertures may be provided in other ways. In one preferred arrangement, the weights forming the stack are fed one by one through an opening in the top of the respective side frame. Alternatively, an entry aperture may be provided in any part of the housing in which the counterweight assembly is vertically slidably movable, and such entry aperture is preferably capable of being covered by a removable cover flap.

In either aspect of the invention, preferably both the upper and lower window units are vertically movable, in respective off-set planes, within guide tracks defined for the window units by the vertical side frame members of the fixed outer frame. However, it is within the scope of the invention for one of the window units to be permanently fixed, and the other one to be vertically slidable.

Cleaning of the inner and outer faces of the window glass of sliding sash windows can be carried out by a cleaner from the inside of the window frame, by sliding movement of the units to gain access to the surfaces to be cleaned, or by use of a ladder to gain access to the outer surfaces, but cleaning by these means can be a tedious task. There is therefore a need to provide a facility whereby the inner and outer surfaces can be readily cleaned by a cleaner standing on the inside of the window frame. This requirement is particularly important to occupants of high rise buildings. Accordingly, in preferred development of the invention, means is provided to allow such cleaning to take place from internally of the fixed frame. This may be obtained by providing a horizontal hinge axis for the lower window unit, which can be activated so as to allow inward pivoting of the lower unit about a hinge axis generally in line with a lower horizontal frame member of the window unit. A limit to the inward pivoting movement may be provided in the form of a stay.

Conveniently, part of the guide tracks on the side frame members of the fixed frame can be disabled, or moved to an inoperative position, thereby allowing inward pivoting movement of the lower window unit and which then allows easy cleaning of the inner and outer surfaces of the lower unit.

The upper window unit will usually be left in an upper position while cleaning of the lower unit takes place, and then the upper unit can be slid downwardly and then also be pivoted inwardly so as to overlie, and preferably at least partly supported by the lower unit, so that its inner and outer surfaces can be cleaned.

The preferred plastics material from which the outer frame and the frames of the window units can be made is extruded PVCU, and provided with metal internal reinforcement as may be required.

The elongate tensile element to connect each counterweight to the respective anchor point of a window unit is preferably made from a strong belt or web of plastics, or reinforced plastics material.

The engagement of the web with the lower edge region of the movable window unit may comprise a secure connection of a free end of the web to a side frame member of the movable unit.

Alternatively, the web may be taken below the lower frame member of the movable unit, and with each end of the web being connected to a respective counterweight whereby the two counterweights apply an upward force to the movable window unit via the engagement of the web with the lower frame member.

Each counterweight may be formed of a stack of two or more weights, introduced one by one into the housings through a suitable entrance aperture e.g. the same aperture through which the web is taken. However, the webs may also be introduced into the housings through another aperture (which is subsequently closed upon completion of the assembly).

Each web may carry an anchor at one end, and a stack of weights can be introduced one by one to form a stack of weights supported by the anchor. The stack of weights may be formed by a cartridge belt type of assembly of at least two weights flexibly connected to each other.

Alternatively, the stack of weights may be arranged one above the other (without any mechanical interconnection), and guided to move up and down within the respective housing by the walls of the housing.

BRIEF DESCRIPTION OF THE DRAWINGS

Preferred embodiments of the invention will now be described in detail, by way of example only, with reference to the accompanying drawings, in which:

FIG. 9 illustrates the web after it has exited from the aperture in the side face of the housing, and spanning between the two side frame members, ready to engage the underside of a lower frame member of a movable window unit;

FIG. 10 illustrates the web engaging the underside of the lower frame member;

DETAILED DESCRIPTION

Figure 1:
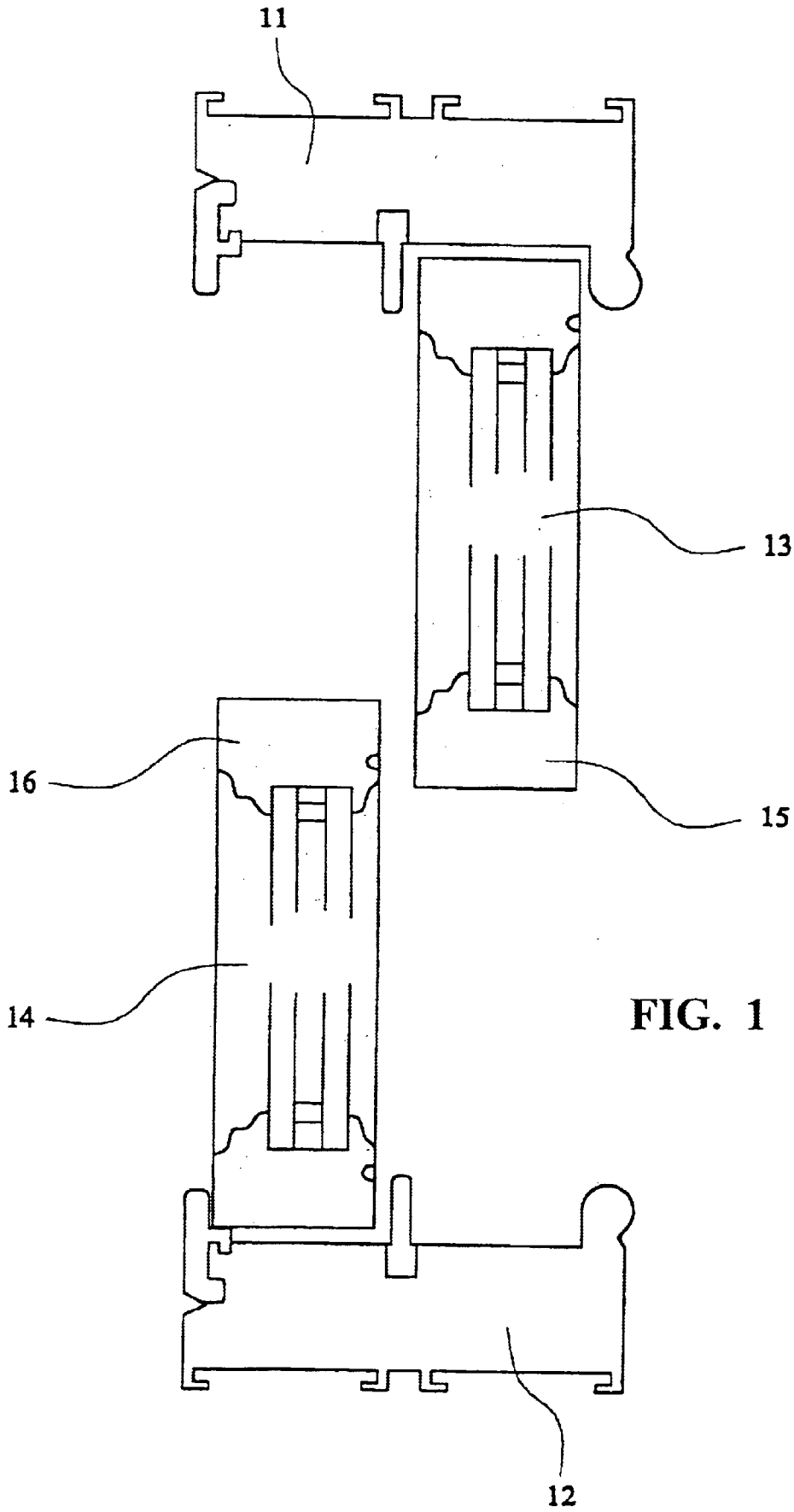
FIG. 1 is a vertical cross sectional view of a sliding sash window assembly of a general type to which the invention may be applied.

Referring first to FIG. 1 of the drawings, this shows a general type of sliding sash window assembly to which the invention may be applied, and which comprises a fixed rectangular outer frame which is securable in a window aperture in a building, and of which there is shown only top and bottom horizontal frame members 11 and 12, although there will also be provided vertical side frame members provided with guide tracks to guide the vertical sliding movement of upper and lower window units 13 and 14 respectively.

In the illustrated arrangement, the upper unit 13 and the lower unit 14 can each move up and down between open and closed positions, and when they are both in the closed position, as shown in FIG. 1, a lower horizontal frame member 15 of the upper unit 13 is located alongside an upper horizontal frame member 16 of the lower unit 14, so that a locking element (not shown) can then lock the frame member to each other and thereby prevent unauthorised attempts at forced opening of the window assembly.

The window units 13 and 14 also have respective rectangular frames, and the rectangular outer frame, and the rectangular frames of the units 13 and 14 are made of extruded PVCU material, and optically provided with metal internal reinforcement if required.

As will be described in more detail below with respect to the further figures of drawings, the sliding sash window type assembly shown in FIG. 1 can be provided with a novel counterweight arrangement, so that, although using modern frame materials, technically advantageous features can be obtained over existing traditional timber designs, and also with enhanced visual aspects, in that the unsightly cords provided in traditional arrangements are no longer visible. However, it is within the scope of the invention to make the frames of plastics material e.g. PVCU, fibreglass, aluminium or timber.

In general terms, novel counterweight arrangements are housed in the vertical side frames of the fixed rectangular outer frame, and are operable to control the upward and downward sliding movement of at least one of the window units in the outer frame. Each counterweight arrangement includes a load connected via an elongate tensile element to a lower end region of the movable window unit. Each tensile element is routed through an aperture in a respective one of the facings which is located at the level of the lower frame member 15 of the upper unit 13 and the upper frame member 16 of the lower unit 14 in the closed position of the window assembly so that, when in this position, the aperture is concealed from view and the tensile element also is not visible.

Furthermore, the load of each counterweight arrangement comprises a cartridge belt type of assembly of at least two weights flexibly connected to each other, and in which the assembly of weights is capable of being fed through the aperture in the respective facing in order to be mounted for vertical sliding movement within the side frame member.

Figure 2:
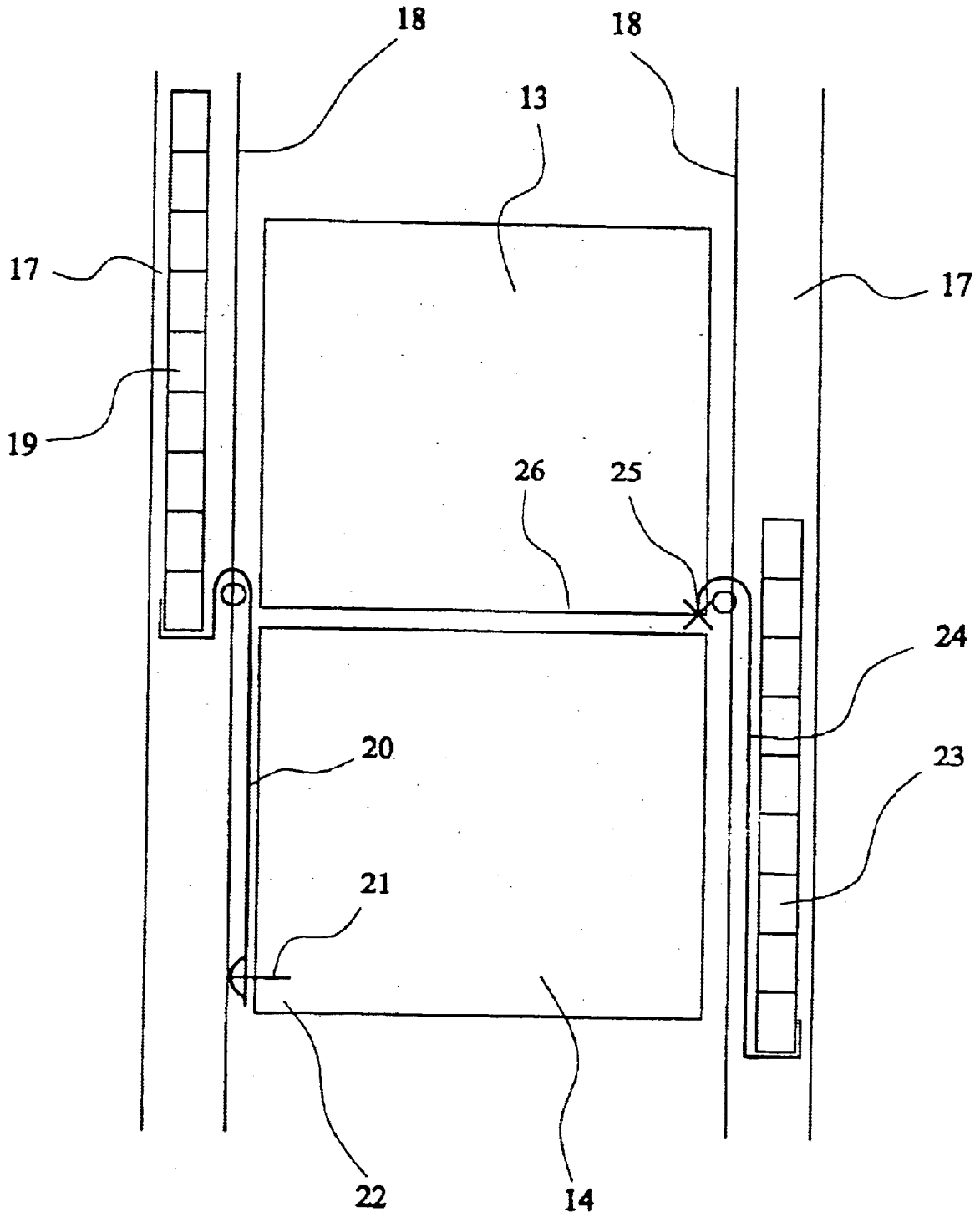
FIG. 2 is a schematic illustration of a novel counterweight arrangement to control the vertical sliding movement of sash windows of a sliding sash window assembly according to the invention.

Referring now to FIG. 2 of the drawings, this is a diagrammatic illustration of a sliding sash type window assembly according to the invention, having a fixed rectangular outer frame, of which there is shown only the vertical side frame members 17, and which define guides permitting upper sash unit 13 and lower sash unit 14 to slide up and down, one in front of the other. Each side frame member has an internal facing 18, and frame member 17 are hollow, defining vertical passages within which counterweight arrangements can move, to provide a counter balance to the vertical sliding movement of the sash units 13 and 14.

FIG. 2 shows one counterweight arrangement in the left hand frame member 17, and which controls the vertical sliding movement of the lower sash unit 14, whereas the right hand frame member 17 shows a counterweight arrangement for controlling the vertical sliding movement of the upper sash unit 13. Only one counterweight arrangement is shown in each frame member for convenience of illustration, although it will be understood that each frame member will define two separate paths of vertical movement for counterweights associated with the respective side of both of the sash units.

Therefore, as shown for the left hand frame member 17, a counterweight arrangement 19 is connected via a tensile element 20 to an anchor point 21 on a lower end region 22 of the lower sash unit 14. The tensile element 20 preferably takes the form of a band or web of high strength material, such as plastics material, preferably reinforced plastics. The right hand frame member 17 shows a counterweight arrangement 23 connected via tensile link 24 to an anchor point 25 on a lower end region 26 of the upper sash unit 13.

Each tensile element 20, 24 is routed through an aperture in a respective one of the facings 18 (not shown in detail) and which is located at the level of the lower frame member 15 of the upper unit 13 and the upper frame member 16 of the lower unit 14, when in the closed position, so that the aperture is concealed from view, and so also the tensile elements 20 and 24 also will not be visible.

As shown only schematically in FIG. 2, each counterweight arrangement 19, 23 comprises a cartridge belt type of assembly of at least two weights flexibly connected together, and which allows the counterweights to be fed through the apertures in the respective facings in order to be mounted for vertical sliding movement within the side frame members 17.

Figure 3:
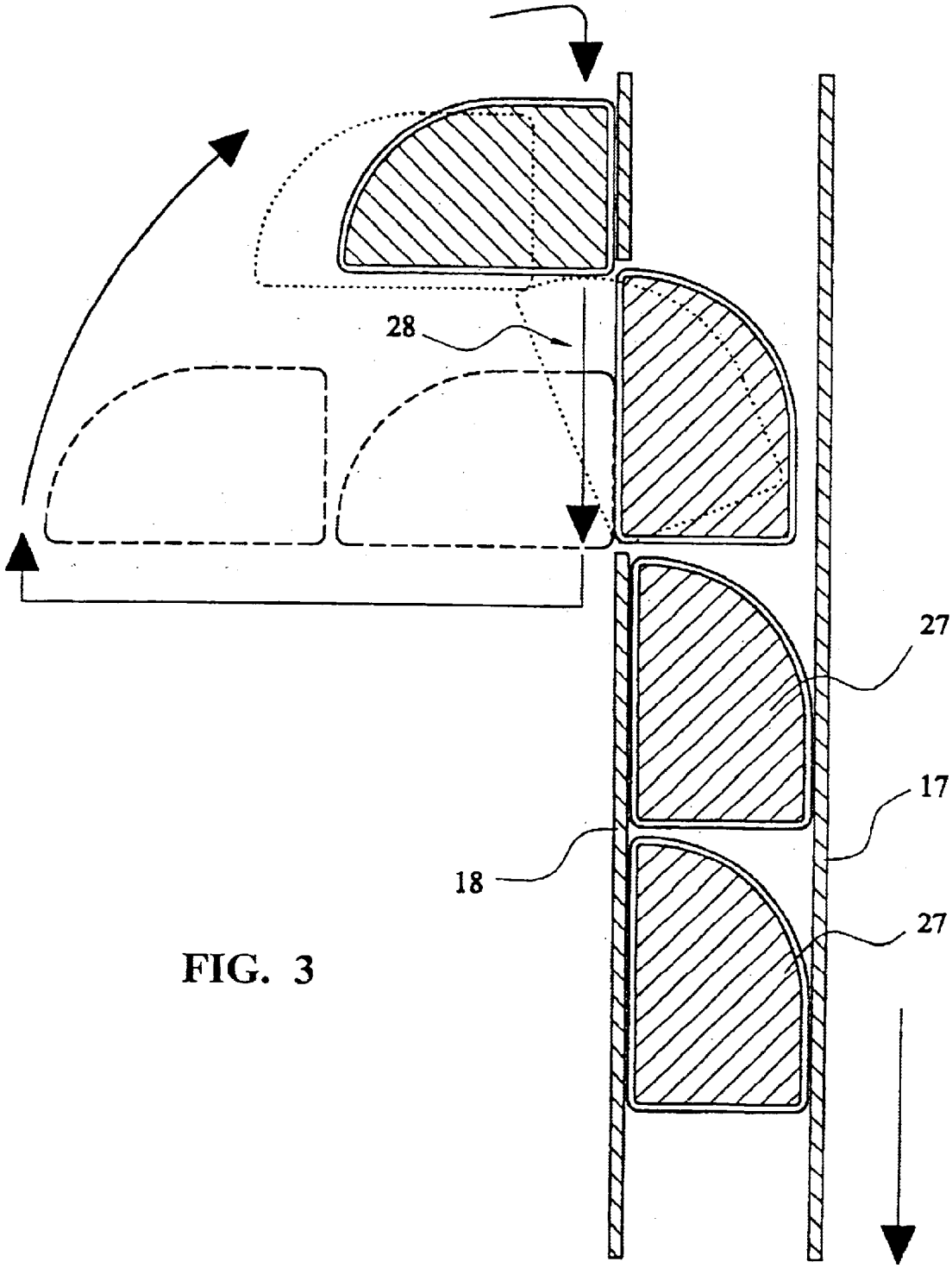
FIG. 3 is a diagrammatic illustration of one example of counterweight arrangement shown in more detail for use in the invention.

FIG. 3 shows in more detail one example of a counterweight arrangement, and which comprises a series of shaped weights 27 which are pivotally connected together in a chain or cartridge arrangement, and as shown in FIG. 3, this assembly of flexibly connected weights 27 can be easily installed by appropriate manipulation to enter the (concealed) aperture 28 in the facing 18 so as to be installed in the side frame member 17.

Figure 4A:
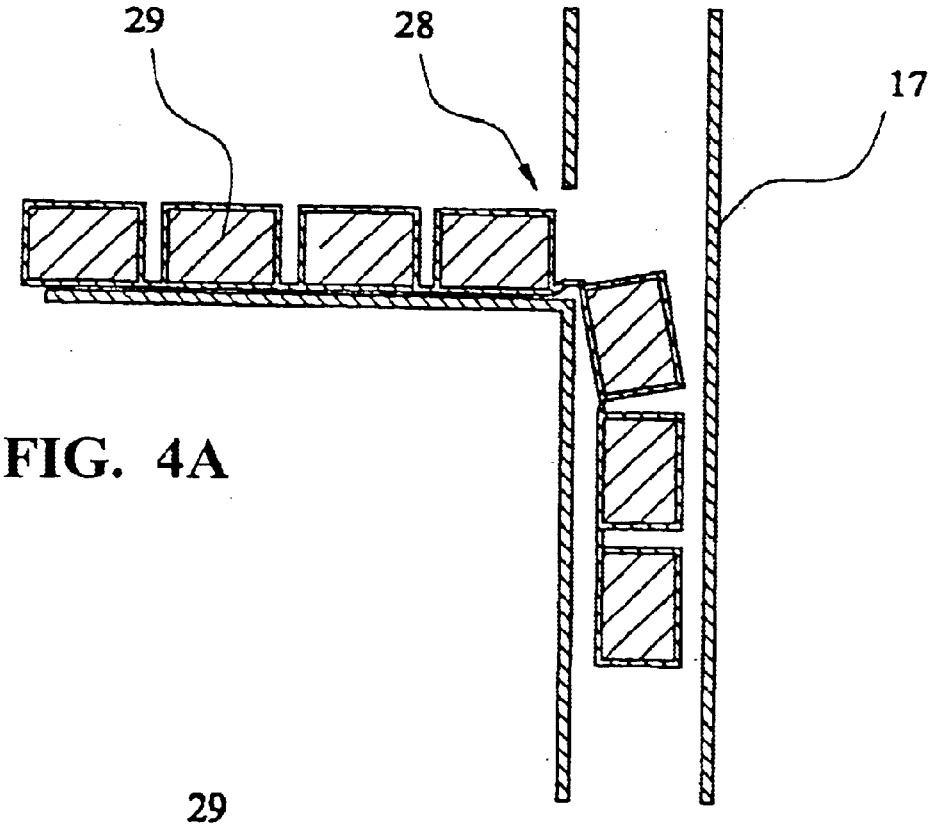
FIG. 4 is a diagrammatic illustration of a further arrangement of counterweight arrangement for use in the invention.
Figure 4B:
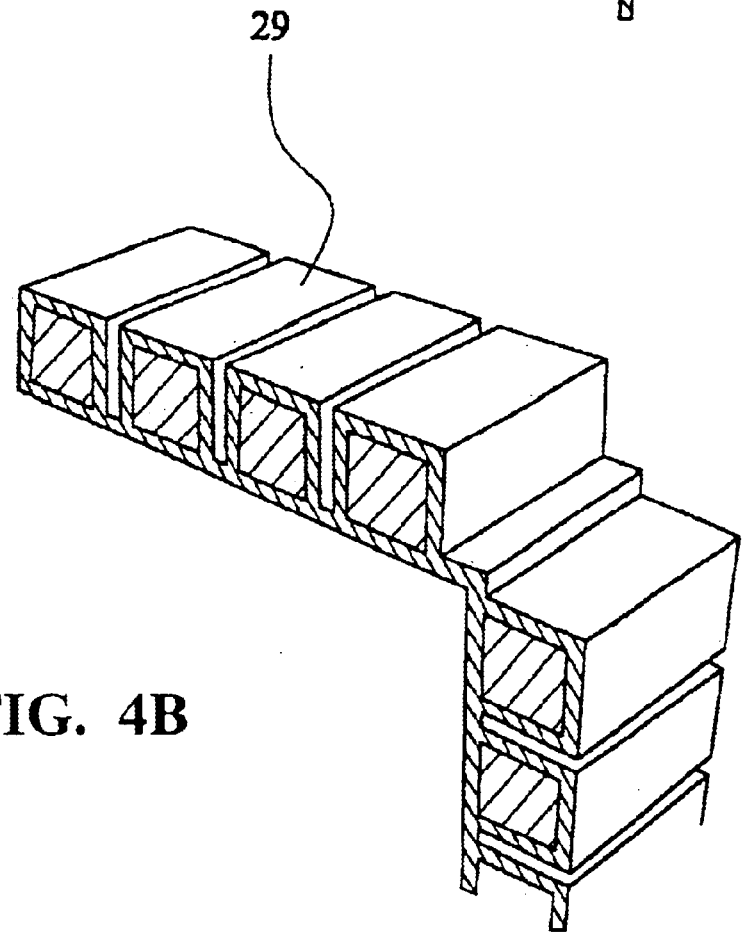
Figure 5A:
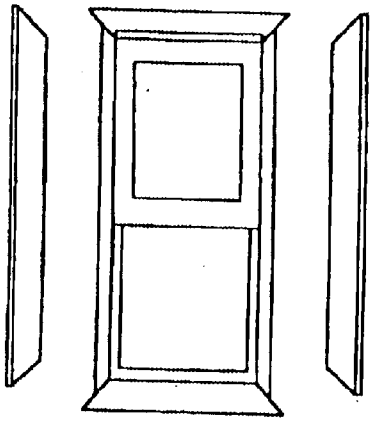
FIG. 5 shows a series of steps in adjustment of a sliding sash window assembly according to the invention, to converted to a mode which facilitates cleaning of the internal and external surface of the glazing units from internally of the fixed window frame.
Figure 5B:
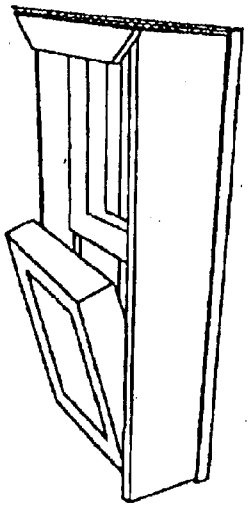
Figure 5C:
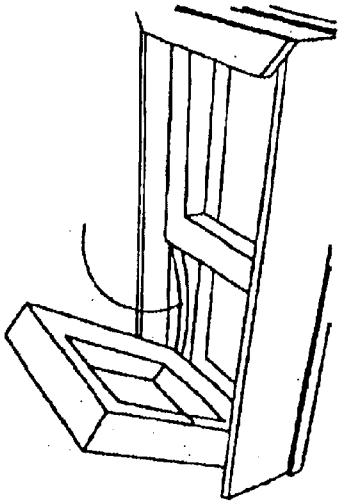
Figure 5D:
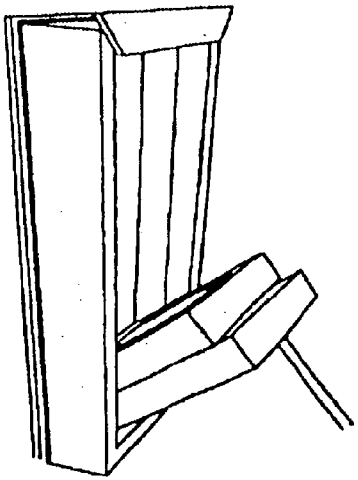
Figure 5E:
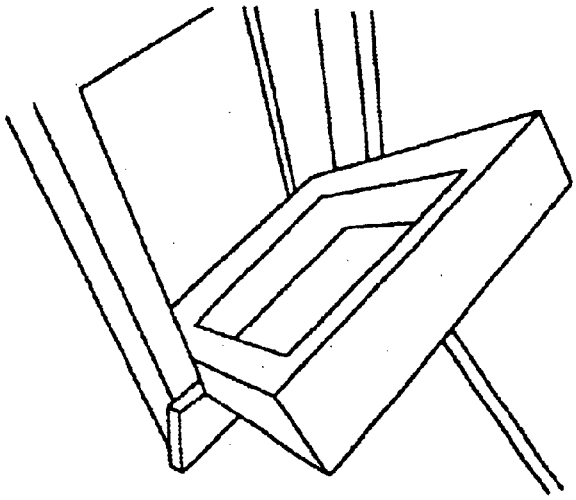
Figure 5F:
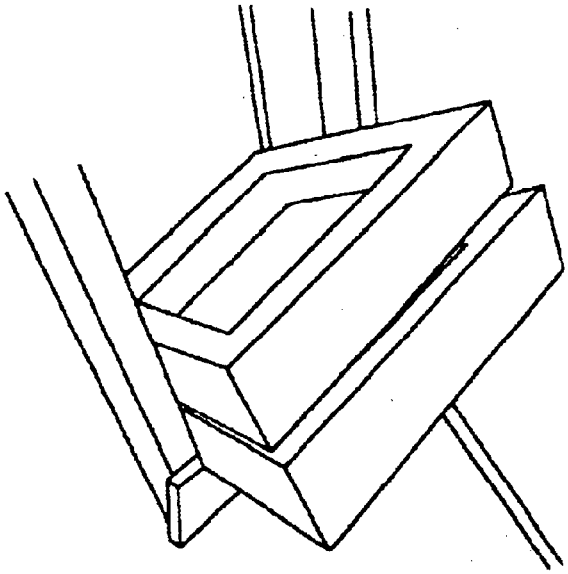
Figure 6A:
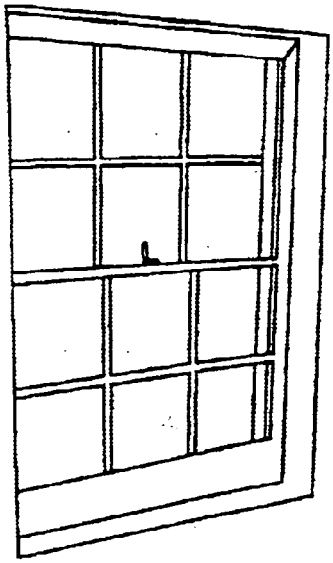
FIG. 6 shows a sequence of steps in the adjustment to the cleaning position in further detail.
Figure 6B:
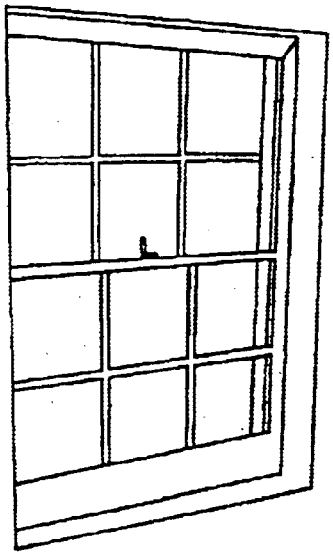
Figure 6C:
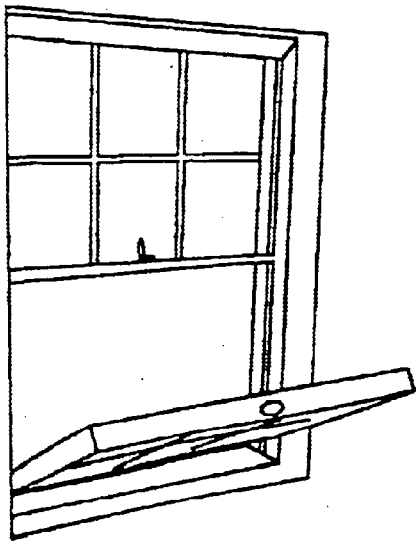
Figure 6D:
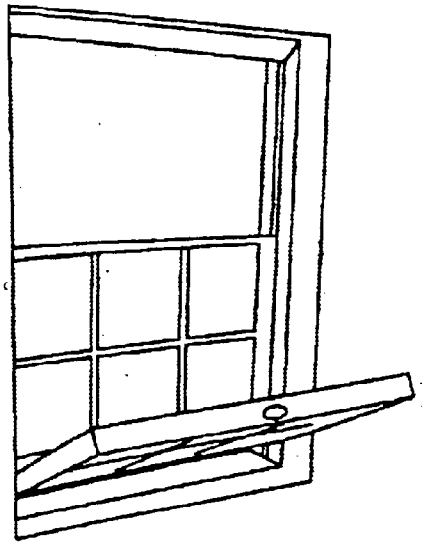
Figure 6E:
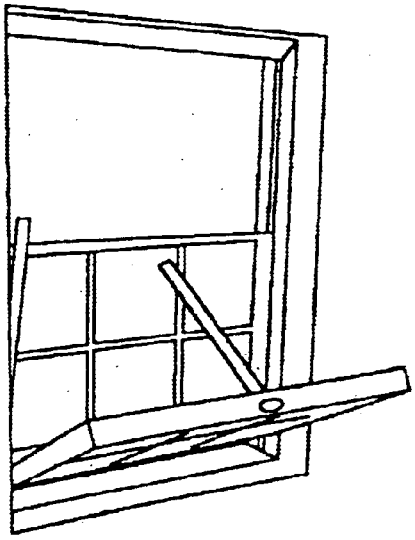
Figure 6F:
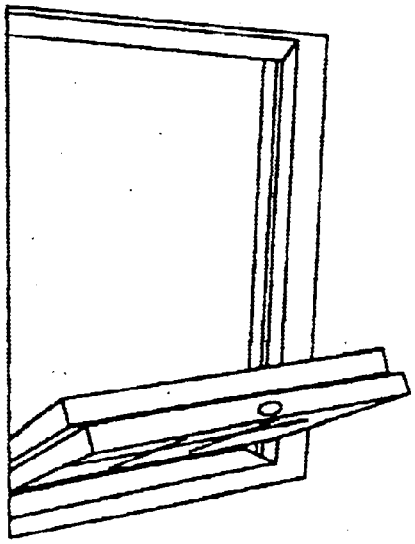

FIG. 4 shows an alternative arrangement of weights, in the form of rectangular slugs of lead or cast iron 29.

Returning to FIG. 2, although the counterweights comprise flexibly connected together individual weights, and which form a stack within each hollow side frame member 17, such a stack is capable of vertical sliding movement, to control vertical movement of the respective sash unit, by reason of the way in which the stacks are housed within respective guide passages in the hollow frame members 17.

This is believed to be a unique arrangement of counterweights, and which has the advantage of providing easy installation, but without the means of installation i.e. routing through the mounting apertures 28 being visible. Furthermore, the tensile elements connecting the counterweights to the respective sash units will normally be concealed from view. Thus, in the case of the upper sash unit 13 as shown in FIG. 2, virtually the entire tensile element 24 is shown located within the interior of the right hand frame member 17. In respect of the tensile element 20, only part of this is located internally of the left hand frame member 17, but the remainder lies alongside the respective vertical frame member of the lower sash unit 22, and this is therefore concealed from view. As the lower unit 14 is raised, more of the tensile elements 20 moves into the interior of the left hand frame member 17, but that portion of the tensile element located externally of the frame member 17 will still remain hidden from view.

To facilitate cleaning of the sash window assembly by a cleaner from the internal side of the fixed frame, a horizontal hinge axis is provided for the lower window unit, which can be activated so as to allow inward pivoting of the lower window unit about its lower horizontal member, and a limit is provided to limit the inward pivoting movement, and preferably taking the form of a stay.

To allow this to take place, part of the guide tracks on the side frame members 17 of the fixed frame are arranged to be capable of being disabled, or moved to an inoperative position, thereby allowing inward pivoting movement of the lower window unit 14. This allows easy cleaning of the inner and outer surfaces of the lower unit 14.

The upper unit 13 will usually be left in an upper position while cleaning of the lower unit takes place, and then the upper unit can be slid downwardly and then also be pivoted inwardly, so as to overlie, and preferably be at least partly supported by the lower unit 14, so that its inner and outer surfaces can be cleaned.

FIG. 5 shows schematically a sequence of operating steps to facilitate this cleaning operation. FIG. 6 shows in more detail the sequence of steps used to facilitate this adjustment to an internal cleaning possibility.

Finally, although not shown in the drawings, the invention also contemplates a modification, whereby counterweight arrangements are housed within the hollow vertical side frame members 17, and flexible bands or belts are utilised in order to connect the counterweight arrangements to the respective vertically sliding sash units, but in which the routing of the band type tensile elements through mounting apertures in the facings is different, whereby the band type elements travel down the exposed faces of the facings, during vertical sliding movement. This modified arrangement is within the scope of the invention, and has the advantage of utilising preferably the flexibly connected together arrangements of counterweights e.g. cartridge belt type or chain type arrangements, plus the superior load bearing properties of a plastics or other band type of connecting element, which avoids the concentrated stresses which would be generated in the traditional cord type of tensile connecting arrangements between lead counterweights and sliding sash window units.

To facilitate installation of the counterweight, all or part of the facings 18 may be removably mounted in position.

The stack of weights forming the counterweight arrangement is pulled up by the web, during lowering movement of the respective sash unit, but moves downwardly under gravity when it is required to return the sash unit to the closed position. The routing of the web may be via an entrance aperture provided at any required position in the frame or facing members making-up the housing, and the stack of weights can be loaded also by any suitable mounting aperture e.g. through the upper ends of the side frame members.

Alternative arrangements, within the scope of the invention, will now be described with reference to FIGS. 7 to 12 of the drawings.

Figure 7:
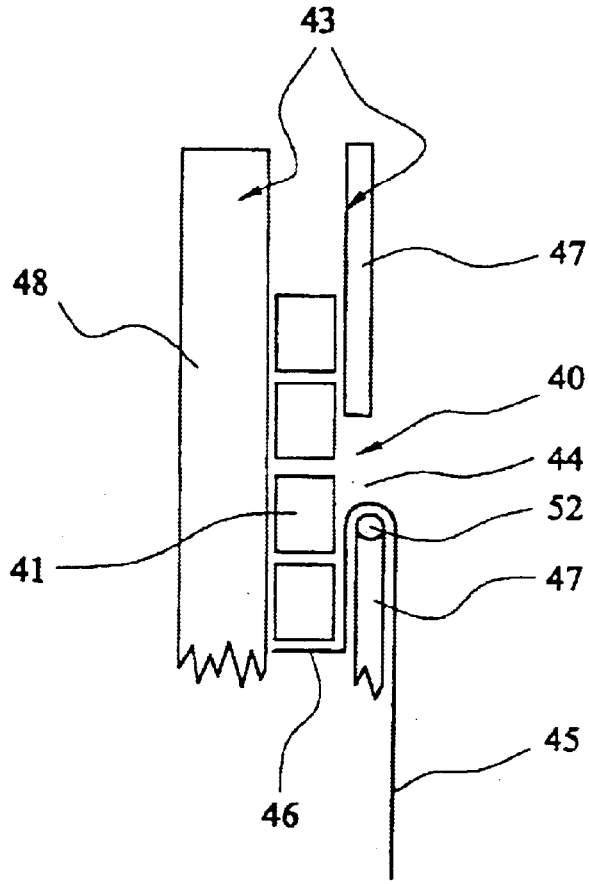
FIG. 7 is a perspective illustration of an alternative arrangement of counterweight for use with the sliding sash window assembly, comprising a stack of weights guided for up and down movement within a housing, and with a lower anchor arranged to one end of a web onto which the stack of weights is applied.

In FIG. 7, there is shown an alternative means by which a counterweight assembly 40 can be formed, and which comprises a stack of two or more weights 41, introduced one by one into the respective counterweight housing 43 (defined by front facing 47 and rear frame component 48) through a suitable entrance aperture 44, which may be the same aperture through which a web 45 is taken, as can be seen in FIG. 7. Each web 45 carries an anchor 46 at each end, and a stack of weights 41 is introduced one by one to form a stack supported by the anchor. This stack of weights, arranged one above the other, does not require any mechanical interconnection, in that the stack of weights is guided to move up and down within the respective housing 43 by engagement with the walls of the housing. The web 45 is preferably guided over a roller 52, which facilitates up and down movement of the web 45 and the counterweight assembly 40.

Figure 8:
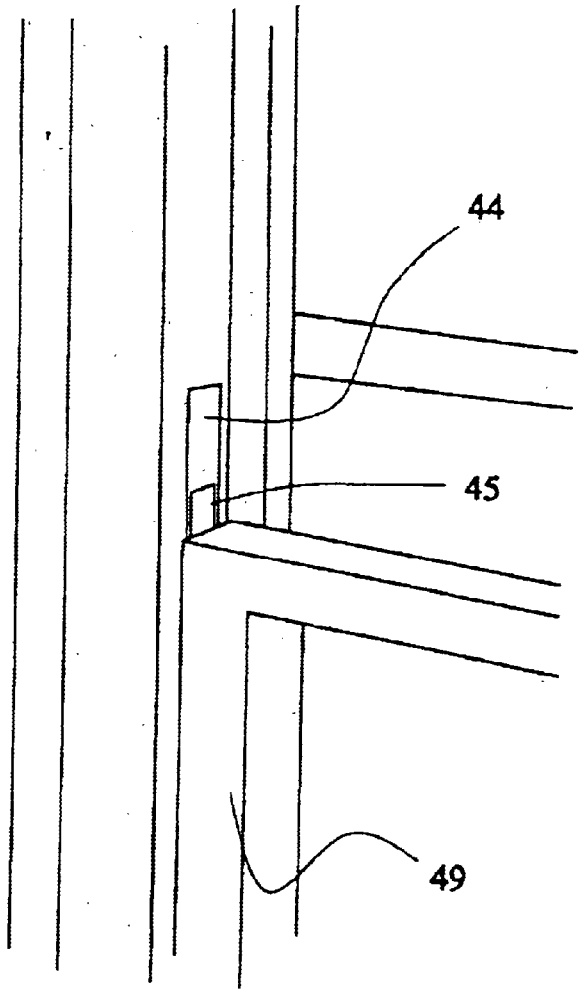
FIG. 8 is a perspective illustration showing the routing of the web out of an entrance aperture in a side face of the housing, and downwardly alongside a hidden face of the movable window unit.

FIG. 8 shows the web run, shown by reference 30, after it has emerged from entrance aperture 44, and before being passed downwardly alongside the hidden face of the vertical side frame member 49 of the movable window unit. The web then is taken below the lower frame member of the movable window unit, as can be seen in FIG. 10, in which the lower run of web is shown by reference 50, engaging the underside of the lower frame member 51. FIG. 9 also shows the lower run of the web 45, after emergence from aperture 44, and spanning between the two vertical side frames of the fixed outer frame, prior to being loaded with the weight of the movable window unit.

Figure 11:
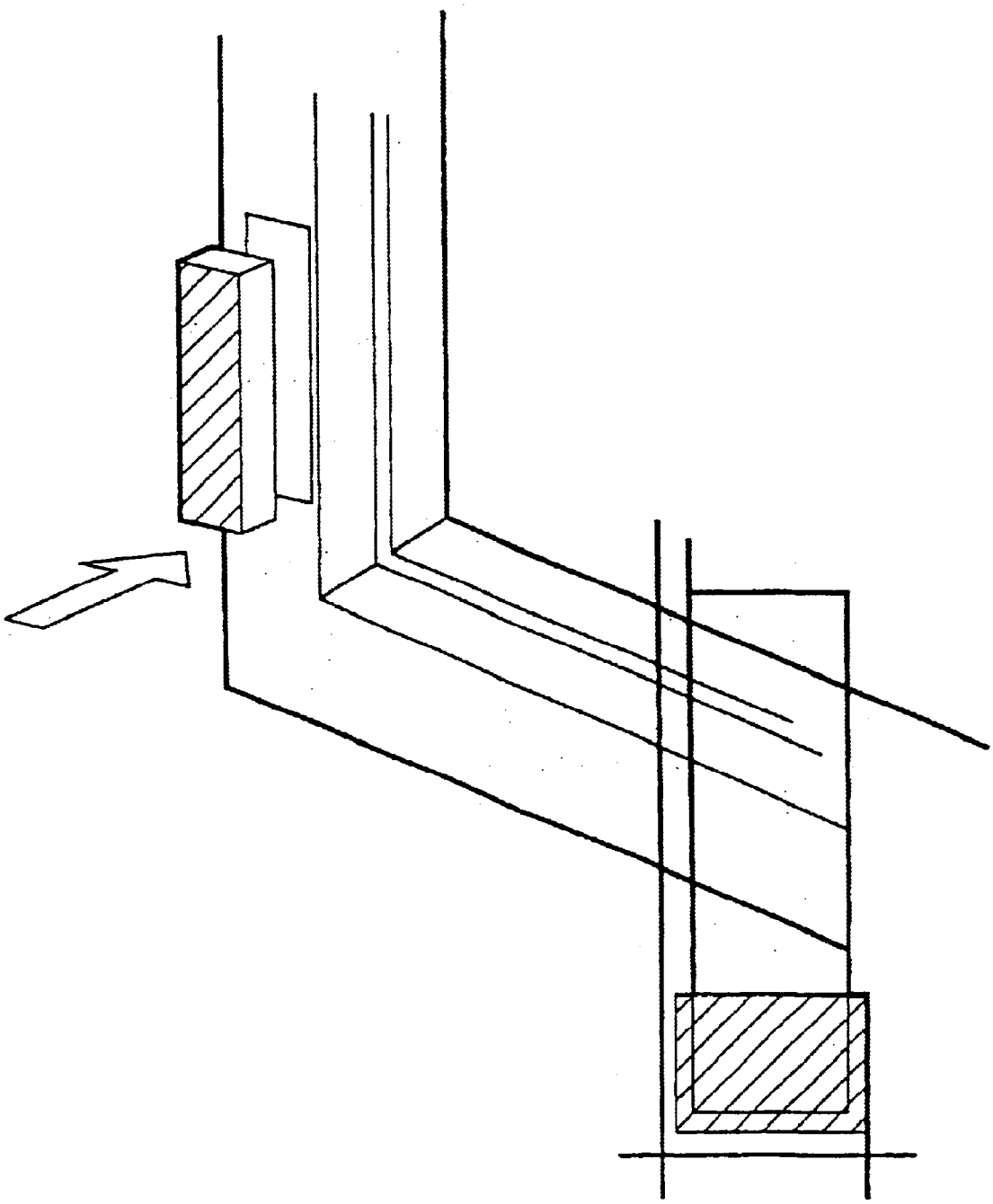
FIG. 11 is a perspective illustration of part of the fixed outer frame in which the window assembly is mounted, and showing an alternative means of introducing weights of the counterweight arrangement to form a stack of weights.

FIG. 11 shows an alternative means for loading each counterweight arrangement, via a different loading aperture, and which comprises a closable access pocket formed in a face of the side frame member.

Figure 12:
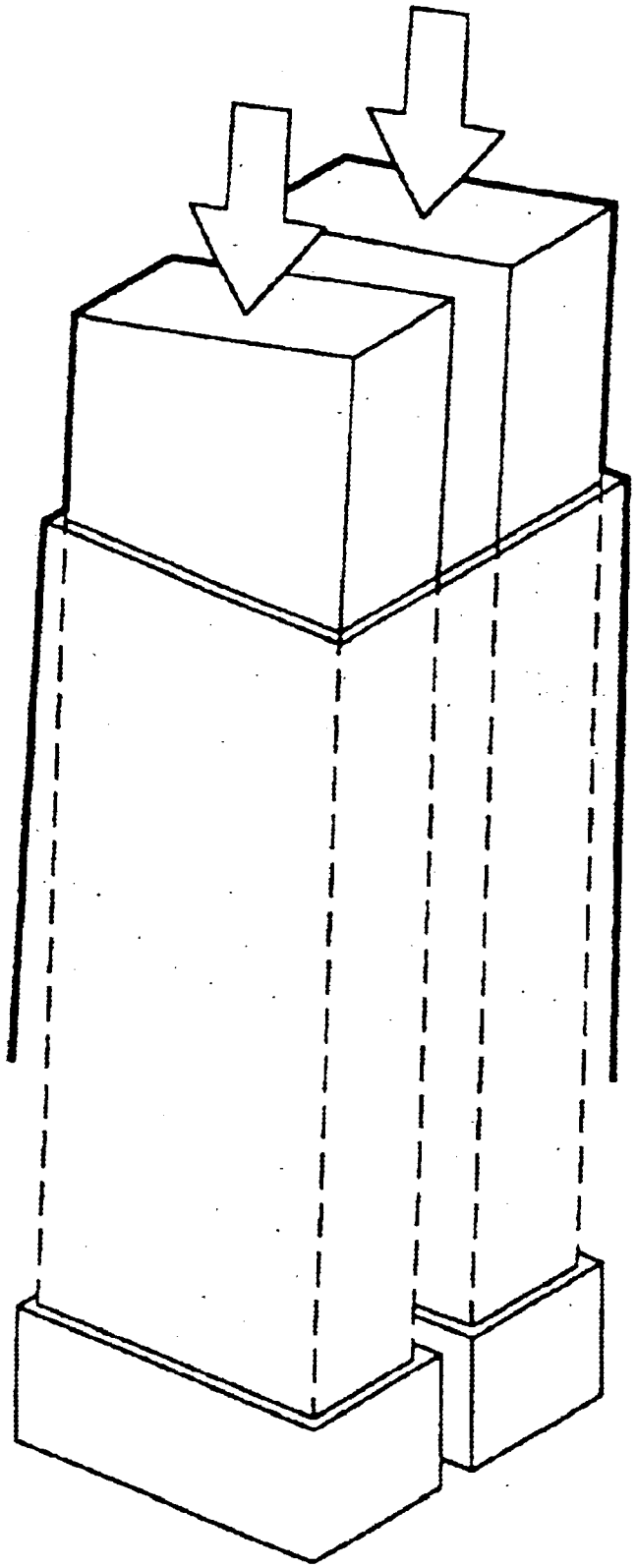
FIG. 12 is a perspective illustration illustrating an alternative means of loading the weights so as to form a stacked counterweight assembly; and, FIG. 13 is a schematic illustration of a still further counterweight arrangement according to the invention.

FIG. 12 shows loading of the weights to form a stack of counterweight, via an upper loading aperture.

Figure 13A:
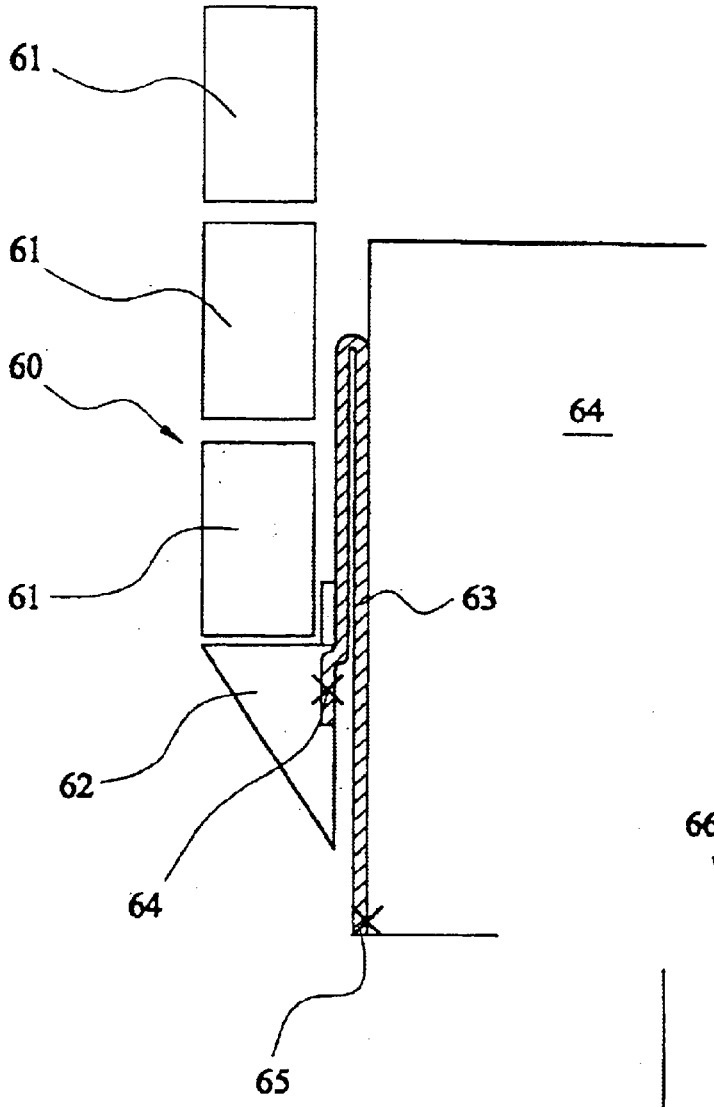
Figure 13B:
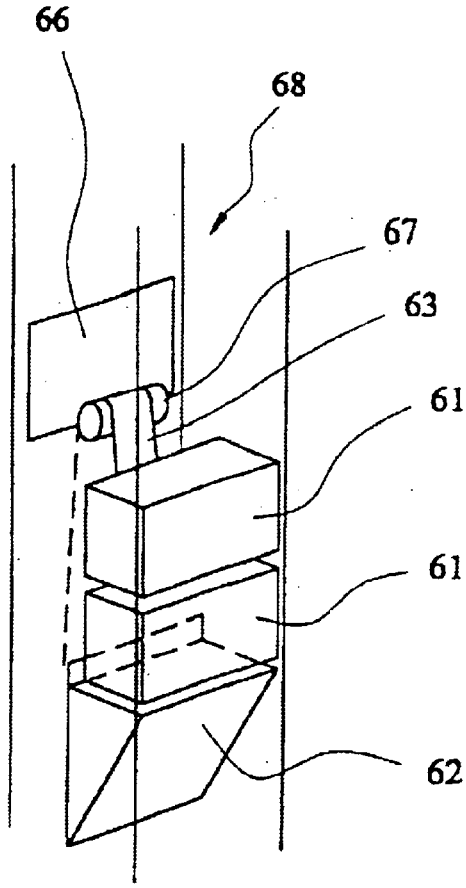

Finally, referring to FIG. 13, this shows schematically a still further arrangement of counterweight assembly which may be utilised in the invention. This counterweight arrangement is designated generally by reference 60, and comprises a stack of weights (slugs) 61, loaded one by one to form the stack, and supported at the bottom end of the stack by a bogie 62, which travels up and down within the housing, and forms a loading platform on which the stack of weights is supported.

FIG. 13 shows a sash belt 63 secured at one end 64 to the bogie 62, and at its other end 65 secured to a fixing point at or near to the lower end of the sash unit 64 whose vertical sliding movement it controls.

FIG. 13 is a detail view showing the stack of weights supported by the bogie 62, and the manner by which the web 63 is routed to the interior of the housing 68 via axis aperture 66, preferably formed in the front facing of the housing, and guided via roller 67.

What is claimed is:

1. A sliding sash window assembly which comprises a fixed rectangular outer frame securable in a window aperture in a building, upper and lower window units mounted in the fixed outer frame and one of said units being relatively movable between an open position and a closed position of the window assembly, respective rectangular frames for said units arranged to permit a lower horizontal frame member of the upper unit to be located alongside an upper horizontal frame member of the lower unit when the window assembly is closed and a locking element for locking the frame members to each other in the closed position and thereby preventing unauthorized attempts at forced opening of the window assembly, in which:

(a) the rectangular outer frame has side frame members in which counterweight arrangements are housed and which are operable to control the upward and downward sliding movement of said one movable window unit in said outer frame, the side frame members having facings to conceal the counterweight arrangements from view;

(b) each counterweight arrangement includes an elongate tensile element which is connected to one end to a lower end region of said one movable window unit and which is connected at its opposite end to a load which is housed behind the respective facing whereby one portion of the elongate tensile element is also located behind the facing, and another portion of the elongate tensile element extends upwardly of said lower end region of said one movable window unit and alongside a side frame thereof during raising and lowering movement of said one movable window unit; and, (c) each elongate tensile element is routed through an aperture in a respective one of the facings which is located generally at the level of the lower horizontal frame member of the upper unit and the upper horizontal frame member of the lower unit in the closed position of the window assembly so that, when in this position, the aperture is concealed from view and the tensile element also is not visible.

2. An assembly according to claim 1, in which both the upper and lower window units are vertically moveable, in respective off-set planes, within guide tracks defined for the window units by the vertical side frame members of the fixed outer frame.

3. An assembly according to claim 1, in which one of the window units is permanently fixed, and the other is mounted to be vertically slidable.

4. An assembly according to claim 1, in which a horizontal hinge axis is provided for the lower window unit, which can be activated so as to allow inward pivoting of the lower unit about the hinge axis, and which is located generally in line with a lower horizontal frame member of the window unit.

5. An assembly according to claim 4, in which a stay is provided to limit inward pivoting movement of the lower unit.

6. An assembly according to claim 4 in which part of the guide tracks on the wide frame members of the fixed frame can be disabled, or moved to an inoperative position, thereby allowing inward pivoting movement of the lower window unit.

7. An assembly according to claim 1, in which the upper unit is slidable downwardly and also is capable of being pivoted inwardly so as to overlie, and at least partly be supported by, the lower unit.

8. An assembly according to claim 1, in which the outer frame and the frames of the window units are made of extruded PVCU.

9. An assembly according to claim 1, in which the elongate tensile element to connect each counterweight to the respective anchor point of a window unit is made from at least one of a belt and a web which is formed from at least one of a plastics material and a reinforced plastics material.

10. An assembly according to claim 9, in which the engagement of the elongate tensile element with the lower edge region of the movable window unit comprises a secure connection of a free end of the elongate tensile element to a side frame member of the movable unit.

11. An assembly according to claim 10, in which each elongate tensile element carries an anchor at one end, and a stack of weights can be introduced one by one to form a stack of weights supported by the anchor.

12. An assembly according to claim 11, in which the stack of weights is formed by a cartridge belt type of assembly of at least two weights flexibly connected to each other.

13. An assembly according to claim 11, in which the stack of weights is arranged one above the other, without any mechanical interconnection, and is guided to move up and down within the respective housing by the walls of the housing.

14. An assembly according to claim 9, in which the elongate tensile element is taken below the lower frame member of the movable unit, and with each end of the elongate tensile element being connected to a respective counterweight whereby the two counterweights apply an upward force to the moveable window unit via the engagement of the elongate tensile element with the lower frame member.

15. An assembly according to claim 1, in which each counterweight is formed of a stack of two or more weights, introduced one by one into the respective housings through a suitable aperture.

16. An assembly according to claim 15, in which the entrance aperture also comprises the same aperture through which the elongate tensile element is taken.

17. A sliding sash window assembly which comprises a fixed rectangular outer frame securable in a window aperture in a building, upper and lower window units mounted in the fixed outer frame and one of said units being relatively movable between an open position and a closed position of the window assembly, and respective rectangular frames for said units arranged to permit a lower horizontal frame member of the upper unit to be located alongside an upper horizontal frame member of the lower unit when the window assembly is closed so that a locking element can lock the frame members to each other and thereby prevent unauthorized attempts at forced opening of the window assembly, in which:

(a) the rectangular outer frame has side frames in which counterweight arrangements are housed and which are operable to control the upward and downward sliding movement of said one movable window unit in said outer frame, the side frames having facings to conceal the counterweight arrangements from view;

(b) each counterweight arrangement includes a load connected to an elongate tensile element and which is engageable with a lower end region of said one movable window unit, wherein the elongated tensile element is made of at least one of a belt and a web which is formed from at least one of a plastics material and a reinforced plastics material; and, (c) each elongate tensile element is routed through an aperture in a respective one of the facings which is located generally at the level of the lower frame member of the upper unit and the upper frame member of the lower unit in the closed position of the window assembly so that, when in this position, the aperture is concealed from view and the tensile element also is not visible, and the elongate tensile element is taken below the lower frame member of said one movable window unit, and each end of the elongate tensile element is connected to a respective counter weight whereby the two counterweights apply an upward force to said movable window unit via the engagement of the elongate tensile element with the lower frame member.

* * * * *